United States Patent [19]

Zimmer

[11] Patent Number: 4,892,057

[45] Date of Patent: Jan. 9, 1990

[54] DEVICE FOR THE APPLICATION OF SMALL AND MINIMAL AMOUNTS OF FLOWABLE SUBSTANCES

[76] Inventor: Johannes Zimmer, Ebentaler Strasse 133, A-9020 Klagenfurt, Austria

[21] Appl. No.: 154,251

[22] PCT Filed: Apr. 29, 1987

[86] PCT No.: PCT/AT87/00032

§ 371 Date: Dec. 23, 1987

§ 102(e) Date: Dec. 23, 1987

[87] PCT Pub. No.: WO87/06504

PCT Pub. Date: Nov. 5, 1987

[30] Foreign Application Priority Data

Apr. 30, 1986 [AT] Austria ..... 1178/86

[51] Int. Cl.[4] ..... B05C 1/08

[52] U.S. Cl. ..... 118/248; 118/414; 118/249; 101/363

[58] Field of Search ..... 118/406, 213, 414, 249, 118/248; 101/363

[56] References Cited

U.S. PATENT DOCUMENTS 3,919,973 11/1975 Zimmer ..... 118/213 X

FOREIGN PATENT DOCUMENTS 0379330 3/1984 Austria .

OTHER PUBLICATIONS

PTO 89-1397; English translation of Austrian Patent No. 379,330; Mar. 1989.

*Primary Examiner*—Shrive Beck
*Assistant Examiner*—Alain Bashore
*Attorney, Agent, or Firm*—Herbert Dubno

[57] ABSTRACT

In a device for the application of flowable substances (6) on a laminar substrate by means of a magnetically pressed applicator roller (4), the device generating the magnetic contact force (1, 14) and also the applicator roller (4) are arranged at an angle, deviating from the vertical direction and a device (5) for the feeding of the substance (6) to be applied is assigned to the applicator roller (4).

6 Claims, 3 Drawing Sheets

DEVICE FOR THE APPLICATION OF SMALL AND MINIMAL AMOUNTS OF FLOWABLE SUBSTANCES

CROSS REFERENCE TO RELATED APPLICATION

This application is a national phase application of PCT/AT/00032 filed 29 Apr. 1987 and based, in turn, upon an Austrian application Ser. No. A 1178/86 filed 30 Apr. 1986 under the International Convention.

A related application is application Ser. No. 07/051,143 filed 4-30-87 now patent No. 4,848,269.

The invention relates to a device for the application of small aamounts of flowable substances to a laminar substrate, e.g. a laminar web of material, by means of an application roller magnetically pressed thereagainst.

BACKGROUND OF THE INVENTION

The application of small or minimal amounts of flowable media to a laminar substrate presents a major problem, if the application is to be completely uniform. On the one hand, it is required to apply exactly the same amount of the medium to each surface unit over the entire width of the web of material and, on the other hand, the contact pressure of the web of material on a support surface must be the same over the entire width of the web.

It is already known to use magnetic wipers for printing or coating of web of material, i.e. roller wipers which are magnetically pressed against the web of material. In these magnetic wipers, from the supply of the medium to be applied, a wedge of flowable substance is formed in front of the magnetic wiper, wherefrom the required amounts of substance are taken.

It is clear that it is not possible in this manner to apply evenly small or minimal amounts of an application medium on a flat substrate, It is also already known to provide a trough with an application roller at the lowest point of the magnetic roller. However, such a trough, located under the magnetic roller is difficult to access and to inspect.

SUMMARY OF THE INVENTION

In accordance with the invention, the device generating the magnetic contact pressure, as well as the application roller are arranged at an angle, deviating from the vertical direction and a device for feeding the substance to be applied is assigned to the application roller.

As a result, when the device for feeding of the substance to be applied is a trough, the area left free for the refilling is readily inspectable and accessible. When this trough is also given the function of a scraper, then only an extremely minimal fluid amount is required for the filling of the trough, approximately 1 liter per meter of length, which is ideal for patterning and the production on a minimal scale, and it is also possible to use easily decomposable substances which are shortlived. A further advantage of the invention is that, when two rollers are laterally arranged, the so-called dosing roller can be of larger dimension, since this roller can be supported and in this way relieved of weight.

When a magnetically pressed application- and/or dosing roller is used, and the same is additionally driven, it is possible to use an axial drive, in addition to the magnetically effected peripheral actuation, and this way a differential speed can be obtained. As a result, a lead of the applicator roller results. In the case of such a lead, there is an additional control of the amount applied, namely an in crease in the amount. Besides, in the case of a lead, a self-cleaning of the applicator- and dosing rollers takes place, since the rollers are slowly wiped off.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
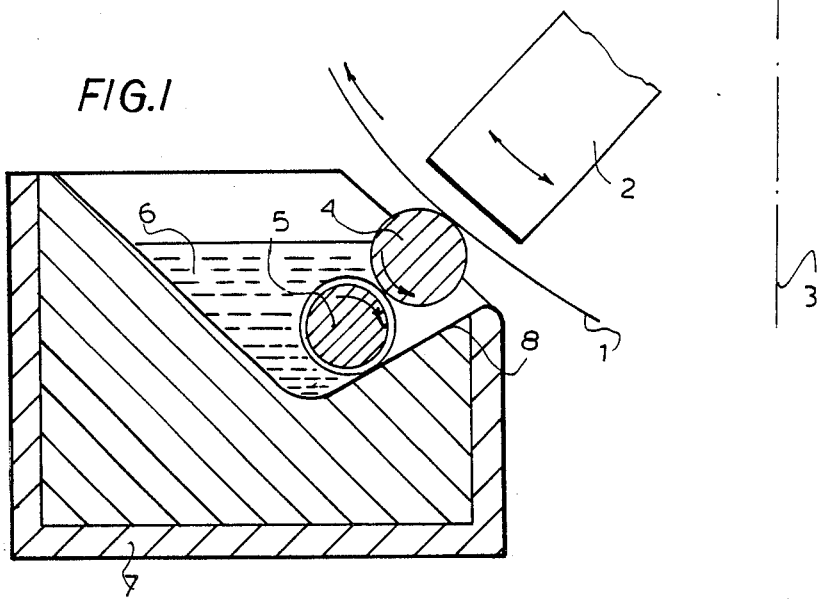
FIG. 1 is a vertical section of an embodiment of the invention.

According to FIG. 1, in a magnet roller 1, a magnet system 2 is located, which is offset with respect with the vertical 3. Also offset with respect to the vertical 3, an applicator roller 4 rests against the magnet roller 1. To this applicator roller 4 a dosing roller 5 is assigned, which dips into the substance 6 to be applied and feeds it to the applicator roller 4. The substance 6 is in a trough 7, which has a surface 8 directed towards the magnet roller 1, upon which the dosing roller 5 rests. In this way, it is possible to increase the diameter of the dosing roller, because the magnet system 2 does not have to carry the weight of the applicator roller 4 and the dosing roller 5, since the surface 8 provides a weight relief is afforded.

Figure 2:
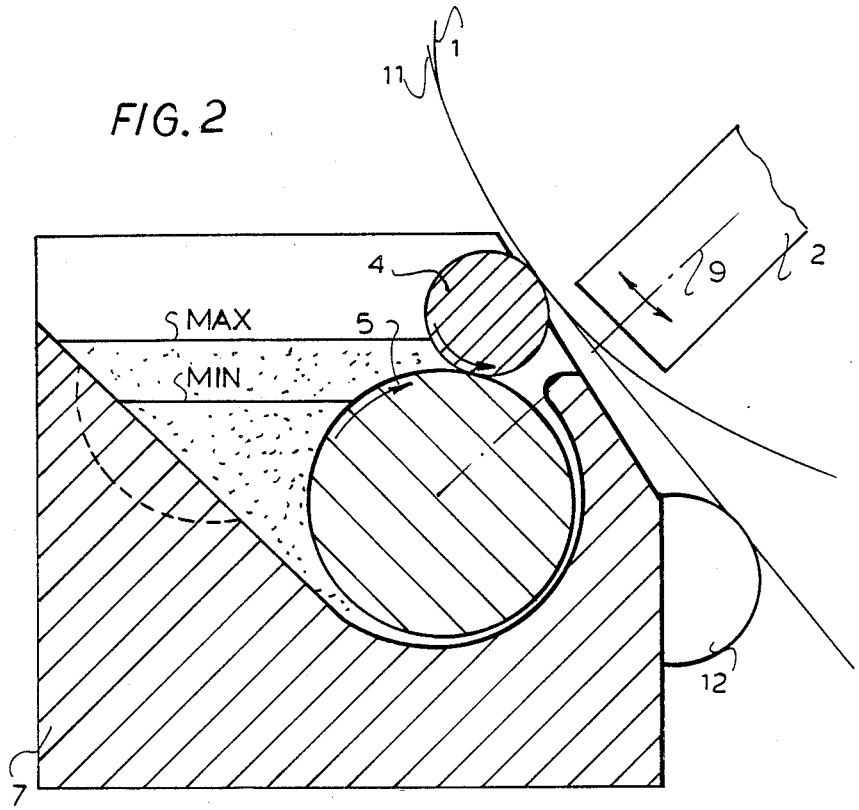
FIG. 2 is a vertical section of another embodiment with a special support for the dosing roller.

In FIG. 2 another embodiment is illustrated. Here, the axes of the dosing roller 5 and the applicator roller 4 are in a different plane than the longitudinal axis 9 of the magnet system 2. In this embodiment, the trough 7 has a recess 10, wherein the dosing roller 5 is mounted. This recess 10 has a diameter which is slightly larger than the diameter of the dosing roller 5, so that the dosing roller 5 floats in the bearing seat created by the recess 10, and during operation, i.e. during its rotation, is wiped off by the wall.

The applicator roller 4 as well as the dosing roller 5 have no axial supports, and this way are freely movable, and the three provided rollers, i.e. magnet roller 1, applicator roller 4 and dosing roller 5, support each other. The magnet system 2 is arranged at an angle of approx. 45° with respect to the vertical and can be swingable about the magnet roller axis, whereby the angular forces and also the distribution of forces between the two rollers 4, 5 can be modified. The walling of the recess 10 can, under certain conditions, also be grooved and the dosing roller 5 as well can present a structured surface, and accordingly to need, it can be grating-like, edged, axially grooved or rough, but it is also possible to use smooth rollers. It is possible to work almost without air. When application is intended, the dosing roller 5 can be smooth, while the applicator roller 4 is structured. After the application, a smoothening wiper can be provided.

In FIG. 2 the web of material 11 is also represented. The web is first is guided over a slide ledge 12, which can also spread the web 11, and only after that passes between the applicator roller 4 and the magnet roller 1.

It is also possible to provide the applicator roller 4 with a yielding surface, e.g. made of soft rubber, and the applicator roller 4, as well as the dosing roller 5 consist of magnetizable material.

Figure 3:
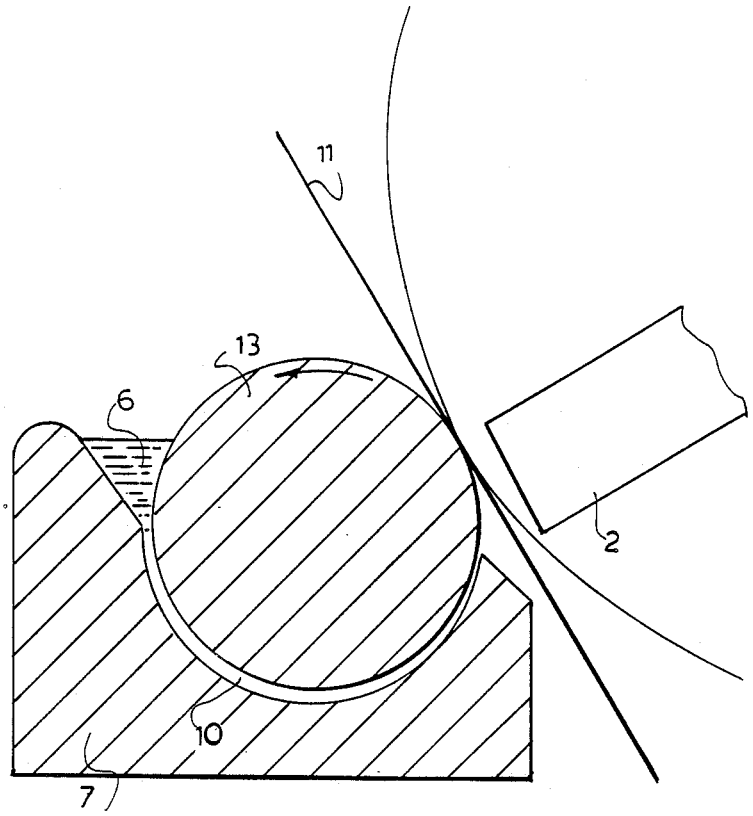
FIG. 3 is a vertical section of a third embodiment with a single roller.

FIG. 3 represents an embodiment wherein the dosing- and applicator roller are replaced by a single roller 13. This roller 13 is located in the recess 10 of the trough 7 and its diameter can be adjusted to the respective needs and it also can be provided with the desired surface. The magnet system 2 has here also the function to press the roller 13 into the recess 10. Above the roller 13, an area for a slab brush and/or suction can be provided. It is advantageous when the trough 7 is movable with respect to the magnet roller 1, in order to insure this way an automatic adjustment and also to compensate irregularities in the material web 11.

In the embodiment of the invention with a dosing- and applicator roller, as well as in the embodiment with a single roller, an additional drive can be provided, so that the roller serving as the applicator has a lead. The peripheral speed can be adjusted very accurately and it is possible this way to also control the applied amounts of substance.

Due to the additional axial drive, a differential speed of the applicator roller is achieved with respect to the other rollers, whereby not only a lead, but also creeping can occur. A lead means an increase in the amount of substance and creeping means a decrease in the amount of substance. The self-cleaning in the case of lead is also important, particularly in the case of substrates which are abrasive, such as glass fibers. The lead can be precisely established, by selecting the speeds. In this case, the applicator rollers should be as smooth as possible.

Figure 4:
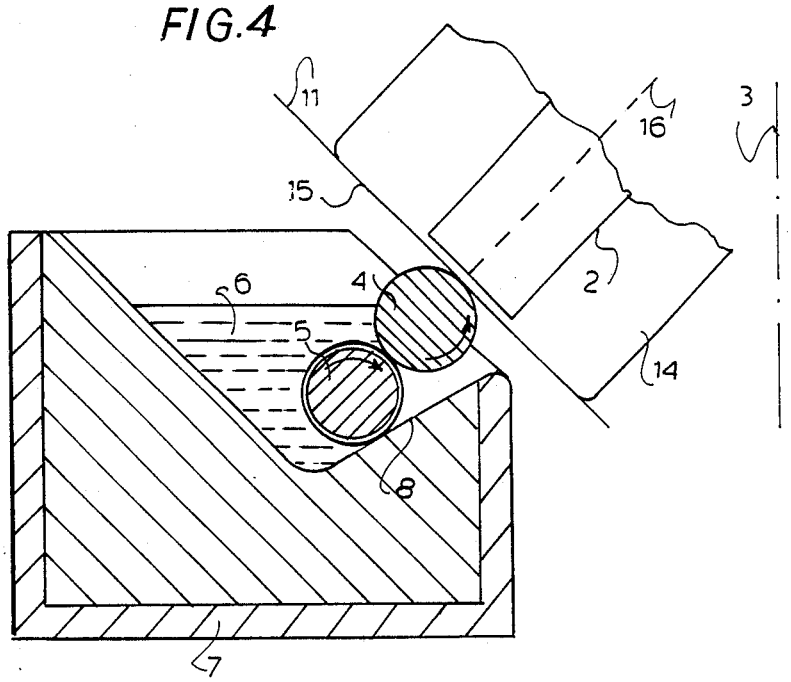
FIG. 4 is a similar view of a fourth embodiment of the invention, wherein the device generating the magnetic contact pressure is a magnet beam.

The device generating the magnetic contact force does not have to be a magnet roller, it is also possible to have a magnet beam. This is shown in FIG. 4. It should be pointed out here that also the embodiment examples according to FIGS. 2 and 3 can be provided with a magnet beam instead of the magnet roller. Such magnet beams 14 are known per se. Generally, they have a table surface 15, over which the material web 11 is guided. The magnet system 2 inserted in the magnet beam 14 ends in the table surface 15 or in its immediate vicinity, this magnet system consisting generally of an electromagnet, with a magnet coil and an iron core. In the embodiment of FIG. 4, the axis 16 of the magnet system is arranged at an angle with respect to the vertical 3. In the area of the table surface 15, the applicator roller 4 is pressed against the web of material 11 and the substance 6 to be applied to fed to this roller due to the dosing roller 5. This substance to be applied is in a trough, which has a surface 8 oriented towards the table surface 15. It is possible to make the magnet beam 14 slidable, in order to be able to change the relative position with respect to the trough, and this way with respect to the applicator roller 4, or to arrange the magnet beam 14 swingably, also in order to make possible a change of position with respect to the application roller 4.

Figure 5:
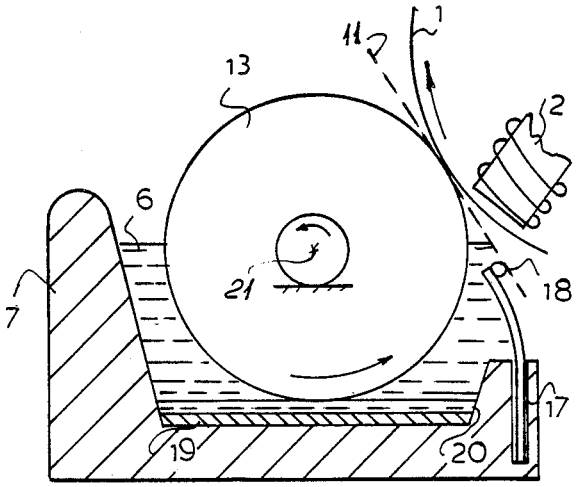
FIG. 5 is a vertical section of a further embodiment.

A further embodiment of the invention is shown in FIG. 5. Here again, a web of material 11 is provided. The dosing and applicator roller is a single roller 13, whereby optionally an additional friction drive can be provided for the roller. The roller can either be supported by means of the axle stump 21 or it can rest on the bottom 19, with ribs 20, so that on this bottom also a dosage can take place. In the through 7 a material strip 17 is supported, which protrudes over the upper rim of the trough and carries a roller 18. The web of material slides over this roller 18 and above the roller 18, an extra accumulation space is defined by roller 13 and the material web 11, which is selectively filled. The material web 11 rests again on a countersurface to the roller 13. The countersurface can be created by a magnet roller 1 with a magnet system 2 or by a magnet beam. The axis of the magnet system 2 forms again an angle with the vertical and is offset with respect to the rotational axis of the roller 13, in FIG. 5.

The material strip 17 and/or the sliding surface 18 for the bodies carrying the web of material 11 can be optionally made of a magnetizable material and be atracted by the magnet system 2. Thereby, the material strip 17 can be prestressed, which can serve as a counterforce to the afforded magnetic force. Thereby, the accumulation space can be precisely kept within certain established limits.

I claim:

1. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller positioned to dip into the substance in a trough to supply said substance to the applicator roller, the magnetic device being lodged inside of a hollow roller and the applicator roller resting against a shell surface of said hollow roller in a circumferential position opposite the magnetic device, and also resting against said dosing roller, the applicator roller is located between and rests against the hollow roller and the dosing roller, said trough being provided with a surface which is inclined with respect to the hollow roller, the dosing roller or the applicator roller resting thereupon.

2. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller positioned to dip into the substance in a trough to supply said substance to the applicator roller, the magnetic device being lodged inside of a hollow roller and the applicator roller resting against a shell surface of said hollow roller in a circumferential position opposite the magnetic device, and also resting against said dosing roller, the applicator roller is located between and rests against the hollow roller and the dosing roller, said trough having a recess, which overlaps the dosing roller or the applicator roller as a circular cylinder, and having a diameter which is slightly larger than the diameter of the dosing roller or the applicator roller.

3. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller positioned to dip into the substance in a trough to supply said substance to the applicator roller, the magnetic device being lodged inside of a hollow roller and the applicator roller resting against a shell surface of said hollow roller in a circumferential position opposite the magnetic device, and also resting against said dosing roller, the applicator roller is located between and rests against the hollow roller and the dosing roller, an inner surface of the recess in the trough being grooved.

4. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller position to dip into the substance in a trough to supply said substance to the applicator roller, the magnetic device being lodged inside of a hollow roller and the applicator roller resting against a shell surface of said hollow roller in a circumferential position opposite the magnetic device, and also resting against said dosing roller, the applicator roller is located between and rests against the hollow roller and the dosing roller, the applicator roller or the dosing roller being driven at differential speeds with a lead of the applicator roller.

5. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller positioned to dip into the substance in a trough to supply said substance to the applicator roller, the magnetic device being lodged inside of a hollow roller and the applicator roller resting against a shell surface of said hollor roller in a circumferential position opposite the magnetic device, and also resting against said dosing roller, the applicator roller is located between and rests against the hollow roller and the dosing roller, a material strip being supported on the trough, which has a sliding surface for the web.

6. A device for applying a small amount of a flowable substance to a web of material, comprising:

an application roller juxtaposed with said web;

means for applying a magnetic force to said roller including a beam so that said roller is magnetically pressed against said web said means for applying said magnetic force being a magnetic device generating force at an angle to the vertical and said applicator roller being arranged at said angle to the vertical said beam having a sliding surface where said application roller is slidable thereon; and a device for feeding the substance to be applied including a dosing roller positioned to dip into the substance in a trough to supply said substance to the applicator roller, the magnetic device being lodged inside of a hollow roller and the applicator roller resting against a shell surface of said hollow roller in a circumferential position opposite the magnetic device, and also resting against said dosing roller, the applicator roller is located between and rests against the hollow roller and the dosing roller, a bottom plate with ribs being provided in the trough the applicator roller or the dosing roller resting upon sad bottom plate.

* * * * *